United States Patent [19]

van Beukering et al.

[11] 3,945,430

[45] Mar. 23, 1976

[54] ROTARY REGENERATIVE HEAT-EXCHANGER

[75] Inventors: Henricus Cornelis Johannes van Beukering, Eindhoven, Netherlands; Albertus Peter Johannes Michels, Briarcliff Manor, N.Y.

[73] Assignee: U.S. Philips Corporation, New York, N.Y.

[22] Filed: Jan. 20, 1975

[21] Appl. No.: 542,352

[30] Foreign Application Priority Data

Feb. 15, 1974 Netherlands ..... 742075

[52] U.S. Cl. ..... 165/9

[51] Int. Cl.² ..... F28D 19/00

[58] Field of Search ..... 165/8, 9, 7

[56] References Cited

UNITED STATES PATENTS

| | | | |
|---|---|---|---|
| 2,747,843 | 5/1956 | Cox et al. | 165/9 |
| 3,389,745 | 6/1968 | Wahlbeck | 165/9 |
| 3,880,225 | 4/1975 | Penny | 165/9 |

*Primary Examiner*—Albert W. Davis, Jr.
*Attorney, Agent, or Firm*—Frank R. Trifari; J. David Dainow

[57] ABSTRACT

A rotary heat-exchanger comprising a control device which is controlled by the variable pressure of one of the two hot and cold gas flows, the control device exerting a force on the rotor which force is proportional to the resultant gas flow pressure, in order to maintain a fixed axial position of the rotor with respect to the rotor housing.

6 Claims, 1 Drawing Figure

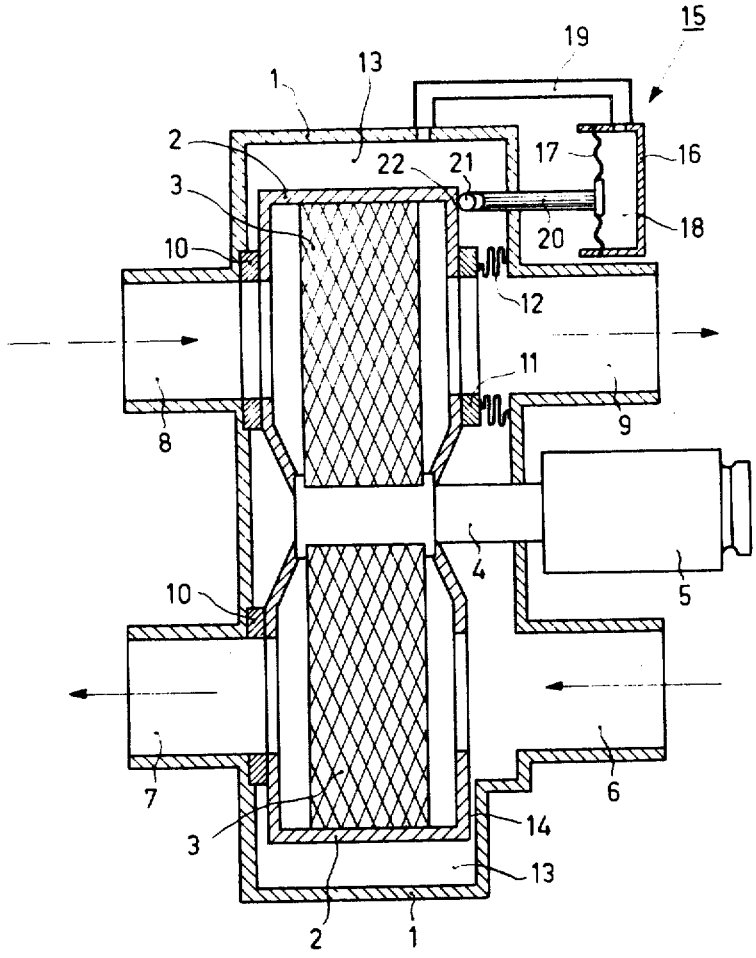
15
19
13
1
2
22
21
17
16
3
20
18
10
12
11
8
9
4
5
10
7
6
3
14
13
2
1

ROTARY REGENERATIVE HEAT-EXCHANGER

BACKGROUND OF THE INVENTION

The invention relates to a rotary regenerative heat-exchanger, provided with a rotor which is accommodated in a stationary rotor housing and which contains a regenerative filling mass. Through the rotor a cold gas flow and a hot gas flow, admitted on both sides of the rotor via a first and a second inlet of the housing, respectively, and having a mutually different variable pressure and velocity, can flow in the axial direction in couterflow, the variable gas flows exerting mutually opposed variable forces on the rotor due to the flow resistance of the filling mass. Sealing members are provided between the rotor end faces and the housing in order to separate the two gas flows.

Rotary heat-exchangers of the kind set forth are known, for example, from German Patent Specification No. 954,061. They are used particularly in power sources such as gas turbines and hot-gas reciprocating engines in order to preheat the cold and compressed combustion air supplied to these power sources by means of the hot flue gases discharged from the said power sources.

Because of the higher viscosity and the higher velocity inherent of the larger volume flow of the hot flue gas of lower pressure with respect to the cold combustion air of higher pressure, the flue gas in the heat exchanger known from said German Patent Specification No. 954,061, exerts a force on the rotor in the axial direction which exceeds the force exerted thereon in the opposite direction by the combustion air. In the case of variations of the load of the power source, the combustion air flow and the flue gas flow also vary, and hence the forces exerted on the rotor by these flows also vary.

On the lower-temperature side of the rotor of this known rotary heat-exchanger, where the inlet for cold air and the outlet for cooled flue gas are situated, there are provided stationary springs which keep the sealing members, constructed as plates, pressed against sealing faces on the relevant end face of the rotor. These springs are pre-tensioned such that in all operating conditions they also keep the sealing faces on the other rotor end face pressed against cooperating, stationary sealing members on the neighbouring opposite rotor housing portion. This means that the sum of the forces exerted by the springs on the rotor should be larger than the maximum resultant force exerted on the springs by the rotor due to the opposed gas flows through the filling mass. The maximum resultant force due to the gas flows occurs at the highest load of the heat-exchanger, which is to say at the largest gas flows, which corresponds to the maximum loading of the power source.

It is a drawback of this known construction that in every operating condition, so also and notably at small gas flows, the rotor is subject to the maximum spring load. This implies that the rotor must always be driven at a torque which is at least equal to the maximum friction torque between rotor and sealing members which is mainly determined by the spring force and the friction coefficient between the sealing members and the rotor sealing faces.

Because of the high spring force required, little freedom exists as regards the choice of the springs, and springs having a high rigidity must be used. The high spring force leads to quick wear of the sealing members and rotor sealing faces.

SUMMARY OF THE INVENTION

The invention has for its object to provide a rotary regenerative heat exchanger in which the described drawbacks are eliminated. To this end, the rotary regenerative heat exchanger according to the invention is characterized in that there is provided at least one control device which is controlled by the variable pressure of one of the gas flows and which exerts a force on the rotor which is proportional to said pressure such that the rotor is maintained in a fixed axial position with respect to the rotor housing in every operating condition.

By making the force in the heat exchanger act in the direction opposite the largest of the two forces exerted by the gas flows, it is achieved that in the case of small gas flows, when the resultant force exerted on the rotor by these gas flows is small, the control device also exerts a small counter-force on the rotor, while in the case of large gas flows, and hence a large resultant gas force, the control device delivers a large counter-force. The axial position of the rotor with respect to the housing thus remains unchanged, so that proper sealing is always ensured.

Because the force exerted on the rotor by the control device in the case of comparatively small gas flows is small, the drive torque required for the rotor is also small. This results in a substantial saving of energy of, for example, the electric drive motor. The springs pressing the sealing members against the sealing faces of the rotor end face may now be flexible, simple and cheap springs. Because of the reduced pressing force at lower loads, the wear of the sealing members and sealing faces is substantially reduced.

In a preferred embodiment of the rotary regenerative heat-exchanger according to the invention, the control device comprises a body which is reciprocatable in a control housing and which separates a first space from a second space, the variable gas flow pressure prevailing in the first space, while in the second space a lower, at least substantially constant pressure prevails, the side of the reciprocatable body which is remote from the first space being connected to a pressing mechanism which cooperates with the rotor.

According to the invention, in the first space preferably the variable pressure of the cold gas flow prevails. The control device can then act on ambient temperature. Moreover, the cold gas flow normally has a pressure higher than the hot gas flow, so that a stronger pressure signal is available.

In a further preferred embodiment of the rotary regenerative heat-exchanger according to the invention, in which the first inlet of the housing for the cold gas flow is in open communication with an intermediate space formed between the rotor circumferential wall and the rotor housing wall, the first space communicates with the intermediate space. This results in a compact construction, notably because of the freedom in the arrangement of the connection duct between the first space and the intermediate space.

According to the invention, in the second space preferably the ambient pressure prevails. This can be readily realized without a separate buffer vessel filled with low-pressure gas being required.

According to a further preferred embodiment of the rotary regenerative heat-exchanger according to the invention, the pressing mechanism comprises a pin one end of which is rigidly connected to the movable body and the other free end of which cooperates with the rotor.

In a preferred embodiment of the rotary heat-exchanger according to the invention, the free pin end supports a rolling member which is journalled to be rotatable at least in the direction of rotation of the rotor and which is in mechanical contact with a rotor running surface.

The rolling member may be, for example, a sphere or a disc. Because of the element rolling on the rotor running surface, substantially less friction and hence less wear occurs between the pressing mechanism and the rotor.

The invention will be described in detail hereinafter with reference to the drawing.

BRIEF DESCRIPTION OF THE DRAWING

The drawing is a view (not to scale) of a preferred embodiment of a rotary regenerative heat-exchanger comprising a control device exerting a variable force on the rotor.

DETAILED DESCRIPTION OF THE PREFERRED EMBODIMENT

The reference numeral 1 in the figure denotes a rotor housing in which a rotor 2 is arranged which contains a regenerative filling mass 3 of, for example, ceramic material or metal. Rotor 2 is mounted on a rod 4 which is passed out of the housing through the housing wall and which is coupled to a reducing gearwheel transmission 5. Via this gearwheel transmission, the rotor can be driven, for example, by means of an electric motor not shown.

Rotor housing 1 is provided with an inlet 6 and an oulet 7 for the gas to be heated and the heated gas, respectively such as combustion air, and an inlet 8 and an outlet 9 for hot gas to be cooled and cooled gas, respectively, such as flue gas.

On the side of the heat-exchanger which is hot during operation, stationary sealing members 10 of, for example, ceramic material are arranged between the rotor end face and the housing wall. On the cold side of the heat-exchanger, at the area of outlet 9, a stationary sealing member 11 is provided between the rotor end face and the housing wall, the said member being pressed against the rotor end face by a resilient bellows sealing 12. The sealing members 10 and 11 and the resilient bellows sealing 12 keep the cold and the hot gas flow separated.

Between the circumferential wall of the rotor 2 and the housing wall there is provided an annular intermediate space 13 which is in open communication, via a gap 14, with the inlet 6 for the gas to be heated.

The heat-exchanger furthermore comprises a control device 15, comprising a control housing 16 in which a diaphragm 17, connected to the housing wall, is reciprocatable, said diaphragm separating a space 18 from the surroundings. Space 18 is in open communication with intermediate space 13 via a duct 19. Diaphragm 17 supports a pin 20 which is provided on its free end with a rotatably journalled sphere 21 which is in contact with a running surface 22 of rotor 2.

During operation, when rotor 2 rotates and compressed, cold combustion air is supplied to inlet 6, the higher pressure air becomes manifest, via gap 14, intermediate space 13 and duct 19, in space 18 and exerts a force to the left on diaphragm 17 which exceeds the force to the right exerted by the ambient atmosphere on the other side of the diaphragm. As a result, the sphere 21 is pressed against rotor running surface 22. In the heat-exchanger the combustion air is heated by flue gases admitted via inlet 8 and originating from the power source (not shown) which initially receives the heated combustion air. The comparatively large volume flow of flue gas of higher viscosity and velocity exerts, via the filling mass 3, a force to the right on the rotor 2 which exceeds the force to the left exerted on the rotor by the comparatively small volume flow of combustion air. Diaphragm 17 has a surface such that the force exerted thereon by the combustion air in space 18 is so large that rotor 2 remains pressed against sealing members 10.

If the load of the power source increases and the volume flows of combustion air and flue gas increase, the resultant gas force to the right on the rotor increases. However, the inlet pressure of the combustion air at the area of inlet 6 is then higher, with the result that the force exerted on the rotor to the left by the diaphragm 17 via pin 20 and sphere 21 is also larger. This means that at any given load the rotor 2 remains pressed against sealing members 10. The value of the force exerted via the diaphragm varies in proportion with the resultant gas force.

The spring force of the bellows sealing 12 can then be smaller because only sealing member 11 need remain pressed against the rotor.

What is claimed is:

1. In a rotary regenerative heat-exchanger operable with cold and hot gas flows which have mutually different variable pressures and velocities, and including a stationary rotor housing having first and second inlets for receiving said cold and hot gas flows respectively and corresponding outlets, a rotor mounted in said housing and containing a regenerative filling mass with gas flow passages therethrough for axial counter flow of said cold and hot gas flows which exert mutually opposed, variable axial forces on said rotor due to flow resistance of said filling mass, and seal means mounted between said housing and rotor for separating said two gas flows therethrough, the improvement in combination therewith comprising at least one control means which is operable in response to said variable pressure of one of said gas flows, and which exerts an axial force on said rotor which force is proportional to the resultant of said forces exerted on said rotor by said gas flows, for maintaining said rotor in a substantially fixed axial position relative to said housing under all conditions of said variable pressure of said gas flows.

2. Apparatus according to claim 1 operable in an ambient environment, wherein said control means comprises a control housing, a body having first and second sides which is reciprocally movable therein and defines in said housing first and second separate spaces corresponding to said first and second sides, first means communicating said first space with said variable gas flows, second means communicating said second space with said ambient environment at a pressure lower than said gas flow pressure, and third means connecting said second side to said rotor for urging the rotor axially when pressure in said first space is greater than pressure in said second space and said body is thereby driven toward said second space.

3. Apparatus according to claim 2 wherein said first space communicates only with said cold gas flow.

4. Apparatus according to claim 3 wherein said rotor has an outer circumferential wall adjacent and spaced from said housing defining an intermediate, annular space, said apparatus further comprising fourth means communicating said first space with said intermediate space.

5. Apparatus according to claim 2 wherein said control means comprises a pin having one end rigidly connected to said movable body, and a second end engaging said rotor.

6. Apparatus according to claim 5 wherein said pin further comprises a rolling member rotatably mounted at said second end for rolling contact with said rotor.

* * * * *

UNITED STATES PATENT AND TRADEMARK OFFICE

CERTIFICATE OF CORRECTION

PATENT NO. : 3,945,430

DATED : March 23, 1976

INVENTOR(S) : HENRICUS CORNELIS JOHANNES VAN BEUKERING ET AL

It is certified that error appears in the above-identified patent and that said Letters Patent are hereby corrected as shown below:

IN THE TITLE: Claim for Priority "742075" should be --7402075

Col. 1, line 13, "couterflow" should be --counterflow--

Signed and Sealed this

Nineteenth Day of October 1976

[SEAL]

*Attest:*

RUTH C. MASON
*Attesting Officer*

C. MARSHALL DANN
*Commissioner of Patents and Trademarks*